US006413078B1

(12) United States Patent
Melcher et al.

(10) Patent No.: US 6,413,078 B1
(45) Date of Patent: Jul. 2, 2002

(54) RESTRICTED OPERATING MODES FOR OIL PRIMARY

(75) Inventors: Amy L. Melcher, Minneapolis; Richard W. Simons, Golden Valley, both of MN (US); Henry E. Troost, IV, River Falls, WI (US)

(73) Assignee: Honeywell International Inc., Morristown, NJ (US)

( * ) Notice: Subject to any disclaimer, the term of this patent is extended or adjusted under 35 U.S.C. 154(b) by 1 day.

(21) Appl. No.: 09/734,354

(22) Filed: Dec. 11, 2000

(51) Int. Cl.[7] ..... F23N 5/20
(52) U.S. Cl. ..... 431/6; 431/70
(58) Field of Search ..... 431/6, 69, 70

(56) References Cited

U.S. PATENT DOCUMENTS

| | | | | |
|---|---|---|---|---|
| 4,303,385 A | * | 12/1981 | Rudich et al. | 431/70 |
| 4,373,898 A | * | 2/1983 | Bohan, Jr. | 431/6 |
| 4,452,582 A | * | 6/1984 | Portasik | 431/70 |
| 4,856,984 A | | 8/1989 | Williams, Jr. | |
| 4,906,177 A | | 3/1990 | Newberry et al. | |
| 4,976,605 A | * | 12/1990 | Geary | 431/69 |
| 5,026,270 A | * | 6/1991 | Adams et al. | 431/69 |
| 5,277,575 A | | 1/1994 | Newberry | |

OTHER PUBLICATIONS

Carlin Combustion Technology, Inc. "Instruction Manual Micro–Controller Based Electronic Oil Burner Primary Control" for Model 50200–02 oil burner primary, Document No. 50233 Revised Aug. 16, 1994.

Honeywell Inc. "R7184A,B,P,U Interrupted Electronic Oil Primary"Installaton Instructions, Document No. 69–1233–1 Rev. 6–99.

* cited by examiner

*Primary Examiner*—Sara Clarke

(57) ABSTRACT

Improved lockout control in oil primary controllers for oil heating systems which allows a reasonable number of user resets and ignition retries in the event of lockout, while minimizing the unwanted accumulation of oil in the combustion chamber of the heating system. When the oil primary goes into lockout mode due to failure of combustion to take place, the oil primary is placed in a restricted mode of operation in which a limited number of reset activations and combustion retries may be attempted. If they are unsuccessful, a waiting time interval is then imposed between further successive attempts. The lockout or trial for ignition time may also be reduced for subsequent attempts, to minimize flooding. Normal operation is returned once a successful combustion cycle has been achieved.

8 Claims, 2 Drawing Sheets

RESTRICTED OPERATING MODES FOR OIL PRIMARY

BACKGROUND OF THE INVENTION

The invention pertains to oil primary controls for oil-fired heating systems, and in particular, to an improved lockout mode control for an oil primary.

Oil heating systems employ a control, referred to generally as an oil primary, which controls the delivery of a fuel oil/air mixture and ignition spark to the combustion chamber of the oil burner. Such systems also use a combustion or flame detector, usually a photosensor, to detect when combustion has successfully begun. This is necessary because, for a number of reasons, it is possible that an attempted ignition may not result in combustion. Such factors include a complete or partial loss of fuel or air, loss of ignition source, or clogged or failed component in the oil burner. One function of the oil primary is to interrupt the flow of oil to the combustion chamber if successful combustion is not detected within a certain time period, which is often referred to as the lockout time or the TFI (trial for ignition) time. If combustion is not confirmed within the lockout time, the oil primary shuts off the flow of oil and air, and igniter spark, and places the system in lockout mode. In lockout mode, the system will no longer respond to a call for heat from a thermostat, which it would do, of course, in a normal mode of operation.

Normally, manual intervention is required to take the system out of lockout mode, either by a service person or by the homeowner/user. A reset button is provided in association with the oil primary to allow user activation of a reset input. Alternatively, it is envisioned that suitable intervention may be provided remotely via a communication link. Since it is possible that the problem which caused the lockout may self-correct, the reset gives the opportunity of successfully starting the oil heating system again. If the restart attempt is successful, it avoids the inconvenience and expense of a service call, and in the worst case, may avoid the prospect of frozen or damaged pipes in the home.

However, if the root problem which caused the lockout has not cleared or is not fixed, a reset will cause another attempted oil ignition cycle, and result in a further lockout. In many instances a homeowner may continue to push the reset button, in an attempt to restart the system. In cases where the system does not clear or correct itself, this will result in flooding of the combustion chamber with unignited oil. This might create a hazard, and may require a service person to come to the site and clean out the combustion chamber, which is a time consuming and costly process. Because of these problems, prior oil primaries, such as the Model R7184 Interrupted Electronic Oil Primary commercially available from Honeywell International Inc., have generally provided a limitation on the reset function, for example, limiting it to three times without successful ignition, after which the system remains in lockout and a service person must be called. This approach has the disadvantage, however, that if service is not readily available during cold periods, occupants may not be able to continue living in the space to be heated, and under certain. circumstances, damage may result due to freezing water pipes.

SUMMARY OF THE INVENTION

The present invention improves on the lockout control of the prior art by allowing flexibility and a greater number of user resets and ignition retries in the event of lockout, while still minimizing the unwanted accumulation of oil in the combustion chamber.

According to the present invention, if lockout occurs due to failure of combustion to take place, the oil primary is placed in a restricted mode of operation in which a limited number of reset activations may be attempted. If they are unsuccessful, a waiting time interval is imposed between successive attempts, and optionally the lockout time is also reduced for such subsequent attempts, to minimize flooding. Normal operation is returned once a successful combustion cycle has been achieved.

According to the present invention, there is provided an oil primary for initiating and controlling oil combustion in an oil heating system, normally in response to a thermostat or Aquastat® signal indicating a call for heat. An ignition detector, such as a Model C554A Cadmium Sulfide Flame Detector commercially available from Honeywell International Inc., provides an indication to the oil primary of whether or not combustion has been achieved in the oil heating system. If combustion is not detected within the lockout time period, oil is shut off and the system is placed in lockout mode. A user reset is provided for receiving user reset inputs, which release the lockout mode to permit the oil primary to retry combustion. In the event of a number of such retries without successful combustion, the system imposes a waiting interval before permitting a further retry in response to a user reset activation.

According to another feature of the invention, after a number of unsuccessful retries, the lockout time period is reduced, to reduce the amount of oil introduced into the combustion chamber on each retry, to further reduce the possibility of oil flooding.

DETAILED DESCRIPTION OF THE INVENTION

Figure 1:
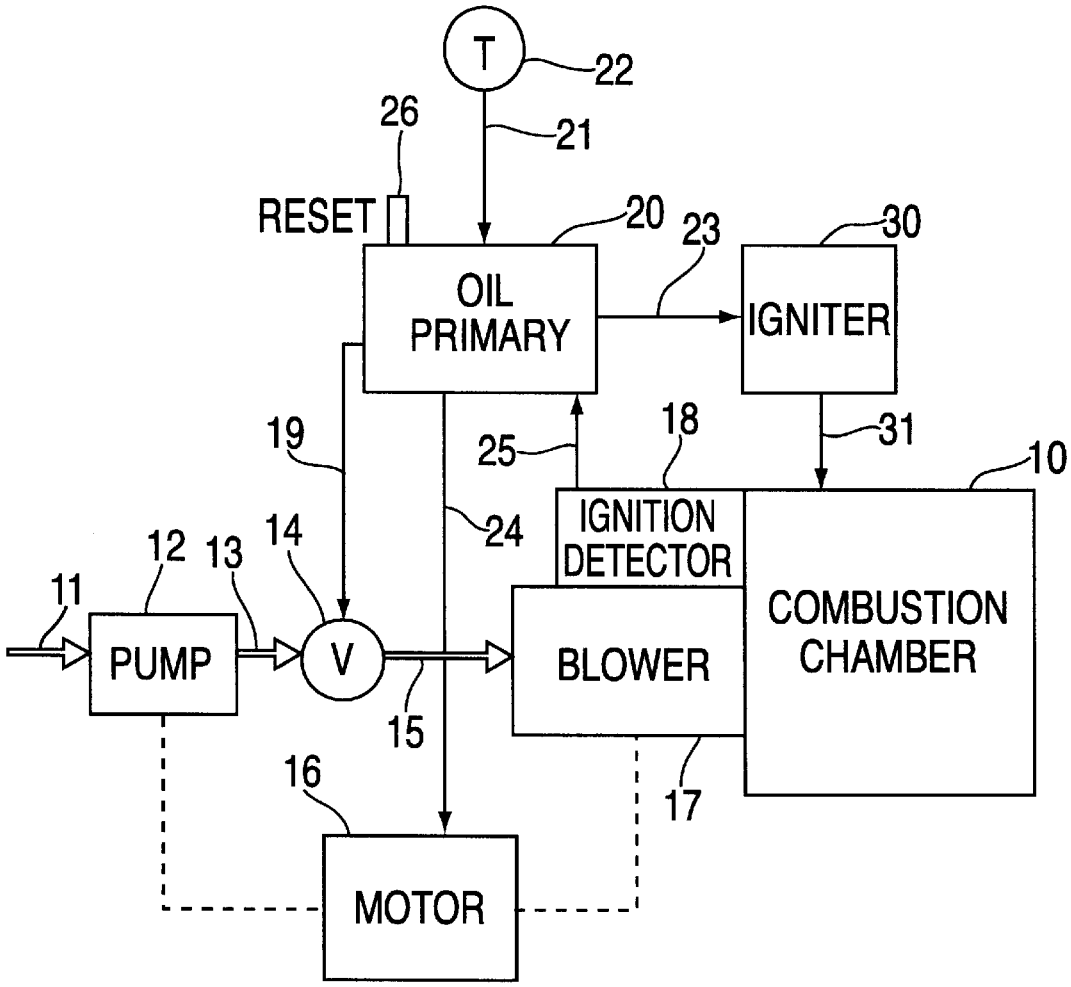
FIG. 1 is a schematic diagram of a control system including an oil primary for an oil burner, of the type to which the present invention may be advantageously applied.

In FIG. 1, an oil burner appliance is shown, including a combustion chamber identified by reference numeral 10. It receives fuel oil from a line 11 from a fuel oil source (not shown), through a pump 12, line 13, valve 14 and line 15. This is representative of certain oil burner appliance designs. Other designs do not include a valve corresponding to valve 14.

An oil primary 20 is provided for controlling the ignition and combustion process. Oil primary 20 receives signals on control line 21 when there is a call for heat to the system. Typically, this is provided by a thermostat or Aquastat® which is indicated at reference number 22. Alternatively, other types of devices could be used for calling for heat, such as a user-activated switch, a timer-activated switch, or the like.

An igniter 30 is provided, which may be part of the oil primary, or a separate device controlled by the oil primary, as is the case in FIG. 1. Igniter 30 is connected at lead 31 to the oil burner appliance, to provide an ignition spark to initiate a combustion cycle. Igniter 30 operates under control of oil primary 20, via the indicated control line 23. Oil primary 20 also controls a motor 16, which drives pump 12 and a blower 17, as indicated, via control line 24. An ignition detector 18 is also provided, positioned to view the flame area within combustion chamber 10, and connected via control line 25 to oil primary 20. Ignition detector 18 may be a Honeywell C554A Cadmium Sulfide Flame Detector.

In normal operation for a heating cycle, oil primary 20 receives a signal, for example, from thermostat or Aquastat® 22, calling for heat. In the system shown in FIG. 1, oil primary 20 first energizes igniter 30 to initiate ignition spark, and then energizes motor 16, which activates pump 12 and blower 17. Thereafter, oil primary 20 supplies a signal over a control line 19 to open valve 14, which introduces fuel oil into the air stream produced by blower 17 to supply oil mist to combustion chamber 10. During a lockout time interval, the oil primary checks for confirmation from ignition detector 18 on control line 25, that acceptable combustion has been achieved. If so, the burn continues through the normal combustion cycle.

However, if during the lockout time the successful establishment of combustion has not been achieved, the oil primary goes into lockout mode. In this mode igniter 30, motor 16 and valve 14 are de-energized, thereby terminating the supply of spark, air and oil mist. The oil primary, while locked out, and will not respond to further signals calling for heat, without a manual reset intervention.

As indicated in FIG. 1, oil primary 20 includes a user-actuatable reset input, commonly in the form of a reset button 26 connected to a switch. Activation of reset button 26 takes the oil primary out of lockout mode, permitting a retry of a combustion cycle. If successful, the combustion cycle proceeds normally. If, however, the retry is not successful, which will most likely be the case if the root cause of the combustion failure has not cleared or been corrected, another lockout will result. The user, typically a homeowner, might activate reset button 26 a number of times trying to reestablish operation of the heating unit. In existing systems, this may cause a significant amount of oil to accumulate in the combustion area, degrading it and ultimately requiring a maintenance service call for cleaning.

Because of this, some prior art oil primaries have limited the number of resets to a small number, typically three retries. If no successful combustion cycle takes place during the three retries, the system remains locked out, necessitating a service call.

The present invention improves upon the prior art by providing a lockout with a restricted user reset capability, which provides the opportunity to restart the system if possible, but which limits the amount of oil accumulation and subsequent degradation of the combustion chamber, if unsuccessful.

Oil primaries may be implemented in different technologies, including relays, discrete or integrated electronic logic, programmed microcontrollers, or various combinations thereof. Likewise, the lockout-reset control of the present invention can be implemented in any of those or other known technologies.

Figure 2:
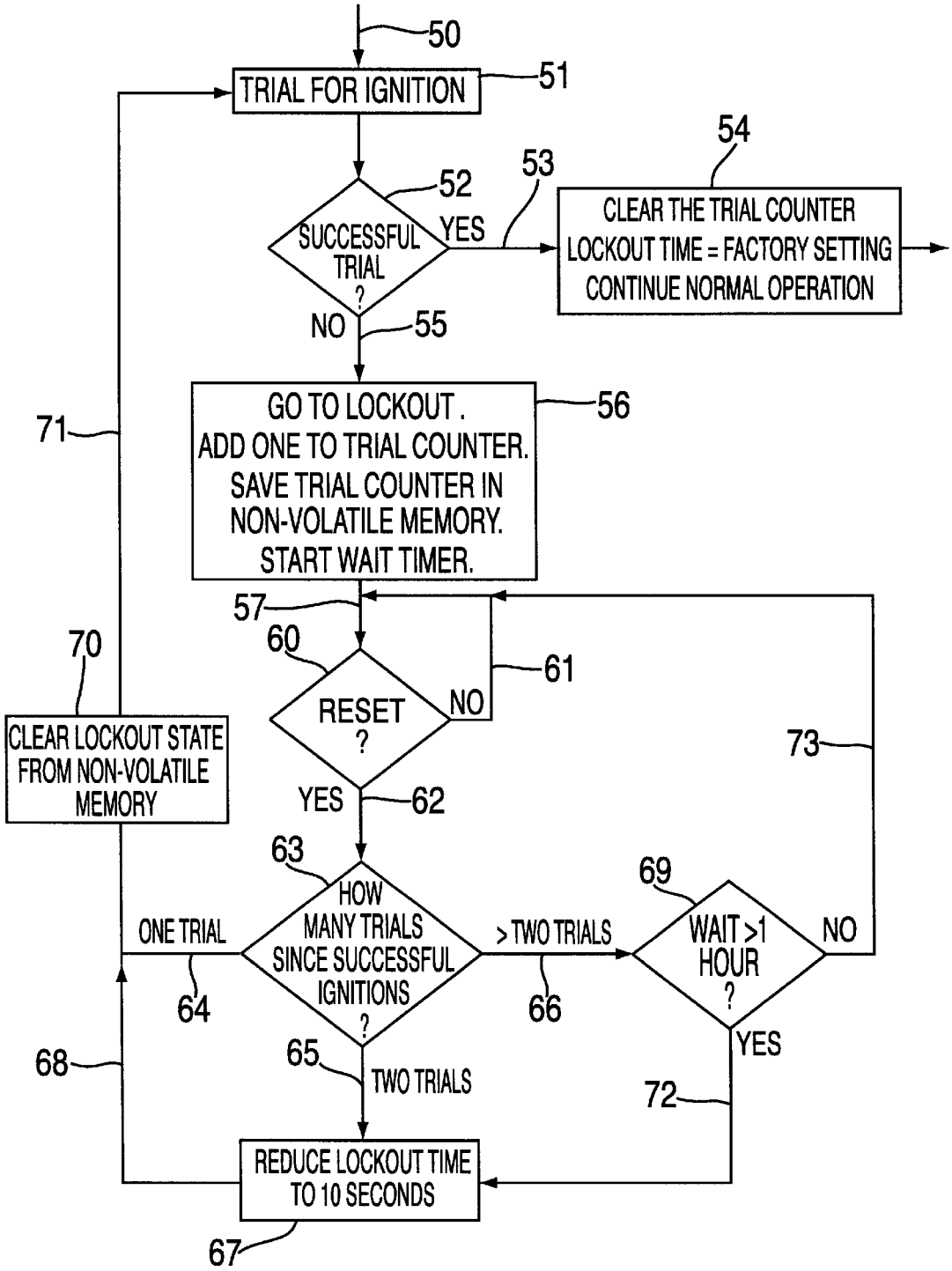
FIG. 2 is a flowchart of restricted lockout control according to an embodiment of the invention.

The embodiment of the invention disclosed herein with reference to FIG. 2 is in the form of software routines to work in conjunction with a microcontroller-based oil primary. The basic operating steps of the oil primary described above are generally known, and are not covered in FIG. 2. FIG. 2 represents a flowchart of the restricted lockout control for the oil primary.

The program of FIG. 2 is shown as beginning at flow arrow 50, which would represent a branch from the main control of the oil primary (not shown) at the beginning of a combustion cycle. Step 51 is the trial for ignition initiation. At step 52, the system tests whether the trial for ignition was successful. A successful test is when the photocell or flame detector confirms that combustion has been established within the lockout time. Typically, the default or factory setting for lockout time would be 45 seconds, although other times for the lockout could easily be selected. In the event of a successful test, control branches to flow path 53 to step 54. At this step, the trial counter (discussed below) is reset to zero, the lockout time is reset to the default or factory settings, and normal operation is continued for a combustion cycle. At this point, the control exits the loop of FIG. 2, and would return to the main control (not shown) of the oil primary.

If the trial for ignition was not successful at decision block 52, control passes through path 55 to step 56. At this point, an increment is added to a trial counter within the programmed microprocessor, which is used to keep track of the number of combustion retries. Concurrently, the control enters the lockout state, which requires manual reset before the ignition process can be reinitiated. A wait timer, used in step 69 below, may also be set at this point. The trial counter and lockout status are stored in a nonvolatile memory associated with the microcontroller for the oil primary. The reason for using nonvolatile memory is so that in the event there has been a power outage, or the user disconnects power to the oil primary and then reconnects it, the lockout status and count of number of trials will be preserved.

From step 56, control passes via path 57 to a decision block 60. This block loops back on path 61 waiting to detect a user reset activation. When the user pushes the reset button or otherwise provides a reset activation, control passes to path 62. Path 62 leads to decision block 63, which checks the trial counter to determine the number of trials since the start of the current non-combustion situation. If this is a first trial, control passes via path 64. If there are two trials, control passes via path 65, and if there have been more than two trials, control passes via path 66.

In the event of a first trial, path 64 takes control to step 70, which causes clearing of the lockout status from nonvolatile memory, but not clearing of the count in the trial counter. Control then proceeds via path 71 back to the start of the trial for ignition. Thus, a retry is enabled. If the retry is successful, as detected at decision block 52, control will pass out block 54, resetting the trial counter to zero as it will no longer be needed. If, however, the trial was not successful, control passes via path 55 to increment the trial counter, and if the reset button is pressed, eventually leads to decision block 63 again.

If there have been two trials, meaning two attempts, the initial attempt and one reset-retry, control will pass to step 67. At this point, the lockout time is reduced to a shorter interval than the original. For example, if the default or factory setting is 30 seconds, the reduced lockout time may be shortened to, for example, 10 seconds. This is to further reduce the amount of oil accumulation in the event of a further unsuccessful retry. Control then passes via path 68 to block 70 and so on, as previously described for a further retry.

If at decision block 63, the number of trials has exceeded two, control passes to decision block 69. At decision block 69, the wait timer is queried to determine whether the wait time has expired since the start of the last retry. The wait time may be set at, for example, 1 hour, although other longer or shorter times may also be used. If the wait time has not expired, control loops back via path 73 to await a reset actuation at step 60. However, as long as the wait time has not expired, the control will be stalled in the loop including decision block 69, effectively preventing a further retry.

If the wait time has expired, control passes via path 72 to block 67, and eventually back to trial for ignition block 51, as previously described.

The operation of the embodiment of FIG. 2 is illustrated in the example shown in the following table. Six trials are shown in the example, the initial thermostat-initiated ignition trial, and five user reset-initiated samples. Note that after trial number 2, the lockout time is reduced from 30 seconds to 10 seconds, which still gives sufficient time to confirm successful combustion, but which if unsuccessful, reduces the total amount of oil accumulation. Note that after trial number 3, a one hour wait is imposed before each successive user-initiated retry, thus further limiting the oil accumulation if the retries are unsuccessful. In this example, six trials were attempted with a total accumulation time of 100 seconds of oil flow, spread out over a period of three hours. By comparison, a prior art lockout control as described above would permit three tries, or 135 seconds of oil, which might all happen within just a few minutes.

| Trial | Trial for Ignition Time | Total Oil Accumulation Time |
|---|---|---|
| #1 | 30 seconds | 30 seconds |
| #2 | 30 seconds | 60 seconds |
| #3 | 10 seconds | 70 seconds |
| One Hour Wait | | |
| #4 | 10 seconds | 80 seconds |
| One Hour Wait | | |
| #5 | 10 seconds | 90 seconds |
| One Hour Wait | | |
| #6 | 10 seconds | 100 seconds |

It will thus be appreciated that the restricted lockout control of the present invention reduces the amount of accumulated oil in the case of a nonfunctioning burner, while at the same time allowing or permitting restart of the burner should the cause of the shutdown correct or clear itself.

It will be seen from the above that the present invention provides an improved oil primary lockout control and method of operation for allowing a reasonable number of user resets and ignition retries in the event of lockout, while still minimizing the unwanted accumulation of oil in the combustion chamber. While specific embodiments of the invention have been described, it will be appreciated that the invention is not limited to those specific applications, and that many variations are possible within the scope of the invention.

What is claimed is:

1. A control system for an oil heating system, comprising:

an oil primary for initiating and controlling combustion in an oil heating system in response to signals calling for heat;

an ignition detector providing an indication to the oil primary of whether combustion is achieved in the oil heating system;

the oil primary operative in response to failure to detect combustion within a lockout time period to enter a lockout mode in which the oil primary does not attempt to initiate combustion in response to signals calling for heat;

a user reset connected as a part of the oil primary; and the oil primary operative in response to a user reset activation to release the lockout mode to permit the oil primary to retry to initiate combustion, and operative in response to a predetermined number of retries without successful combustion to impose a waiting interval before permitting a further retry in response to a user reset activation.

2. A control system according to claim 1 wherein the oil primary is operative to decrease the lockout time period for detection of combustion after a predetermined number of retries without successful combustion.

3. A control system for an oil heating system, comprising:

an oil flow control selectively controllable to deliver oil to a combustion area of the oil heating system;

an ignition control selectively actuable to ignite oil in the combustion area;

a combustion control normally operative in a combustion mode to activate the oil flow control and the ignition control in response to a need for heat to be produced by the heating system;

an ignition detector providing an indication of the state of combustion of oil in the combustion area of the oil heating system;

a lockout control operably connected to the ignition detector and the oil flow control, and operative in a lockout mode to cause the oil flow control to shut off delivery of oil to the combustion area if satisfactory combustion is not detected within a lockout time interval;

a reset control operatively connected to receive user reset commands, and connected to selectively release the lockout mode to permit attempted initiation of the combustion mode; and the reset control operative in response to the occurrence of multiple unsuccessful attempts to initiate the combustion mode to require a waiting time period before releasing the lockout mode for a successive attempt.

4. A control system according to claim 3 wherein the reset control is operative in response to the occurrence of three unsuccessful attempts to initiate the combustion mode to require a waiting time period before releasing the lockout mode for a successive attempt.

5. A control system according to claim 3 wherein the lockout time interval is reduced to a shorter interval in response to the occurrence of multiple unsuccessful attempts to initiate the combustion mode.

6. A control system according to claim 5 wherein the lockout time interval is initially approximately 30 seconds, and is reduced to approximately 10 seconds in response to the occurrence of multiple unsuccessful attempts to initiate the combustion mode.

7. A method of controlling combustion in an oil heating system, comprising:

initiating oil combustion in response to thermostat signals calling for heat;

detecting whether combustion has been achieved within a lockout time interval after attempted combustion;

in response to failure to achieve combustion within the lockout time interval, preventing the system from further attempts to initiate combustion in response to thermostat signals calling for heat;

in response to a user reset input, permitting a further attempt to initiate combustion; and in response to a number of successive unsuccessful attempts to initiate combustion, waiting for the expiration of a waiting period before again attempting to initiate combustion in response to a successive user reset input.

8. The method of claim 7 wherein the lockout time interval for detecting combustion is shortened after a number of successive unsuccessful attempts to initiate combustion.

* * * * *